US009167893B2

(12) United States Patent
Shiraishi

(10) Patent No.: US 9,167,893 B2
(45) Date of Patent: Oct. 27, 2015

(54) FOLDING TABLE

(71) Applicant: NEWTEC JAPAN Co., Ltd., Yokohama-shi, Kanagawa (JP)

(72) Inventor: Tokuhiro Shiraishi, Yokohama (JP)

(73) Assignee: NEWTEC JAPAN Co., Ltd., Kanagawa (JP)

( * ) Notice: Subject to any disclaimer, the term of this patent is extended or adjusted under 35 U.S.C. 154(b) by 0 days.

(21) Appl. No.: 14/293,020

(22) Filed: Jun. 2, 2014

(65) Prior Publication Data

US 2014/0373760 A1 Dec. 25, 2014

(30) Foreign Application Priority Data

Jun. 24, 2013 (JP) ..... 2013-131463

(51) Int. Cl.
*A47B 3/083* (2006.01)
*A47B 3/00* (2006.01)

(52) U.S. Cl.
CPC ..... *A47B 3/083* (2013.01); *A47B 3/002* (2013.01)

(58) Field of Classification Search
CPC .... A47B 3/0087; A47B 3/091; A47B 3/0915; A47B 3/0916; A47B 3/087
USPC ..... 108/171, 173, 170, 115, 35, 36; 248/188, 188.1, 188.6
See application file for complete search history.

(56) References Cited

U.S. PATENT DOCUMENTS

| | | | | | |
|---|---|---|---|---|---|
| 1,965,700 | A | * | 7/1934 | Hatfield | 108/35 |
| 1,976,140 | A | * | 10/1934 | Paul | 108/173 |
| 2,035,718 | A | * | 3/1936 | Perl | 108/173 |
| 2,559,357 | A | * | 7/1951 | Holt, Jr. | 108/35 |
| 2,709,631 | A | * | 5/1955 | Covucci | 108/36 |
| 2,781,525 | A | * | 2/1957 | Bauer | 108/173 |
| 2,837,394 | A | * | 6/1958 | Rahall | 108/25 |
| 3,144,841 | A | * | 8/1964 | Meringoff | 108/36 |
| 3,174,796 | A | * | 3/1965 | Brown | 108/173 |

* cited by examiner

*Primary Examiner* — Jose V Chen
(74) *Attorney, Agent, or Firm* — Rankin, Hill & Clark LLP

(57) ABSTRACT

The invention relates to a folding table including: two tabletop members that are coupled to each other pivotably with one edges of the tabletop members serving as an axis, and are able to be folded; leg members that are disposed on a lower surface of a tabletop formed by unfolding the two tabletop members; a separation biasing unit that causes two leg members to move away from each other; and a movably coupling unit that couples the leg members to the tabletop members in such a manner as to be moveable from the one edge side to the other edge side. When the tabletop members are pivoted to unfold the tabletop, the separation biasing unit and the movably coupling unit cause the leg members to be unfolded along the lower surface of the tabletop.

12 Claims, 5 Drawing Sheets

FOLDING TABLE

BACKGROUND OF THE INVENTION

1. Field of the Invention

The present invention relates to a folding table provided with a tabletop formed by unfolding two tabletop members right and left, and a plurality of leg members provided on a lower surface of the tabletop to support the tabletop.

2. Description of the Related Art

Conventionally, portable folding tables on which cookingware and foods and drinks are put have been widely used for cooking and eating outside in recreation such as outdoor activities. General conventional portable folding tables include one that has a two-fold tabletop, and leg members that are attached to the tabletop unfolded right and left (Patent Document 1, for example), and one that is set up by pulling out leg members pivotably attached to a tabletop (Patent Document 2, for example).

These folding tables can be transitioned into a small compact state with the tabletop separated or folded. However, a predetermined procedure, involving a plurality of operations, needs to be followed for setting up or putting away the folding tables. Thus, the operations, for setting up the table in outdoors, and the like, are not always easy.

Furthermore, the conventional folding tables include a large number of components, which not only makes the setting up operations and the like cumbersome but also makes the table heavy. Thus, many of the conventional folding tables are not easy to carry around.

Thus, a folding table, which anyone can easily set up and carry around, so that outdoor recreations can be comfortably enjoyed, has been called for.

Patent Document 1: Japanese Patent Application Laid-open No. 2012-143378

Patent Document 2: Japanese Patent Application Laid-open No. 2011-15945

An object of the present invention is to provide a folding table, which has high portability, can be set up easily, and still has sufficient rigidity to be used in outdoors.

SUMMARY OF THE INVENTION

The inventors have gone through trial and error to achieve the object and came up with the following configuration and thus made the present invention. Specifically, a separation biasing unit and a movably coupling unit are provided in a folding table including a tabletop formed by unfolding two tabletop members right and left, and a plurality of leg members provided on a lower surface of the tabletop to support the tabletop. The separation biasing unit causes two leg members, disposed on the lower surface of the tabletop and positioned in opposition across an axis of pivot of the tabletop members, to move away from each other. The movably coupling unit couples the leg members to the tabletop members in such a manner as to be moveable from the one edge side, serving as the axis of pivot, of the tabletop members, to the other edge side thereof. Thus, when the tabletop members are pivoted to unfold the tabletop, the leg members are unfolded right and left along the lower surface of the tabletop, as the tabletop members pivot, whereby the table can be easily set up.

Specifically, the present invention is a folding table including: two tabletop members that are coupled to each other pivotably with one edges of the tabletop members serving as an axis, and are able to be folded such that lower surface sides thereof face each other; a plurality of leg members that are disposed on a lower surface of a tabletop formed by unfolding the two tabletop members right and left, in order to support the tabletop; a separation biasing unit that causes two leg members, disposed on the lower surface of the tabletop and positioned in opposition across an axis of pivot of the tabletop members, to move away from each other; and a movably coupling unit that couples the leg members to the tabletop members in such a manner as to be moveable from the one edge side, serving as the axis of pivot, of the tabletop members, to the other edge side thereof. When the tabletop members are pivoted to unfold the tabletop, the separation biasing unit and the movably coupling unit cause the leg members to be unfolded right and left along the lower surface of the tabletop, as the tabletop members pivot.

Furthermore, the present invention is a folding table, in which the separation biasing unit couples the two leg members with each other through an elastic body, and causes the two leg members to move away from each other with elastic force of the elastic body.

Furthermore, the present invention is a folding table, in which the separation biasing unit couples together parts of the two leg members, each made of an elastic body, and causes the two leg members to move away from each other with elastic force of the elastic body.

Furthermore, the present invention is a folding table, in which the separation biasing unit is formed by bending a rod-shaped elastic body forming the two leg members, and disposing a first pivotably coupling portion and a second pivotably coupling portion apart from each other along the axis of pivot of the tabletop members, the first pivotably coupling portion coupling, in a horizontally pivotable manner, a distal end of a lower end extending portion extending from a lower end of one leg member with a distal end of an upper end extending portion or a lower end extending portion extending from an upper end or a lower end of another leg member, the second pivotably coupling portion coupling, in a horizontally pivotable manner, a distal end of an upper end extending portion extending from an upper end of the one leg member with a distal end of the upper end extending portion or the lower end extending portion extending from the upper end or the lower end of the other leg member, to produce the elastic force in the rod-shaped elastic body when the two leg members move closer to each other such that the two leg members move away from each other by the elastic force.

Furthermore, the present invention is a folding table, in which the movably coupling unit movably couples the leg members to the tabletop members by providing a guide member that is disposed on the lower surface of each of the tabletop members and includes a through hole extending from the one edge side, serving as the axis of pivot, of the tabletop members, to the other edge side thereof, and by inserting the upper end extending portion extending from the upper end of the leg member into the through hole.

Furthermore, the present invention is a folding table, in which two guide members are respectively disposed on the two pivotable tabletop members so as to oppose each other across the axis, and the tabletop is able to be folded such that the lower surface sides of the two tabletop members face each other by pivotably coupling adjacent facing portions of the two guide members with each other.

Furthermore, the present invention is a folding table, in which side walls are disposed on the lower surfaces of the tabletop members, along edges on opposite sides to the axis of pivot, such that when the tabletop members pivot and the tabletop is folded, the leg members, the separation biasing unit, and the movably coupling unit are accommodated in a space surrounded by the tabletop members and the side walls.

According to the folding table of the present invention, when the tabletop is unfolded by pivoting the tabletop members, the leg members are also unfolded right and left on the lower surface of the tabletop as the tabletop members pivot. Thus, the table can be set up easily.

Furthermore, when the tabletop is folded by pivoting the tabletop members, the leg members can be accommodated between the two tabletop members. Thus, the table can be easily carried around. Furthermore, the side walls are disposed along the edges on the other sides of the axis of pivot on the lower surfaces of the tabletop members. Thus, when the tabletop is folded, all of the leg members, the separation biasing unit, and the movably coupling unit can be accommodated within the space surrounded by the two tabletop members and the sidewalls disposed on the tabletop members, whereby high portability can be achieved.

BRIEF DESCRIPTION OF THE DRAWINGS

FIG. 2 is an enlarged view of a lower surface of the folding table

FIG. 3 is a diagram showing the structure of a separation biasing unit

FIG. 4 is a diagram showing operations of the separation biasing unit FIG. 5 is a diagram showing an unfolding operation of the folding table

DESCRIPTION OF THE PREFERRED EMBODIMENTS

A folding table of the present invention will be described below by referring to the figures.

Figure 1:
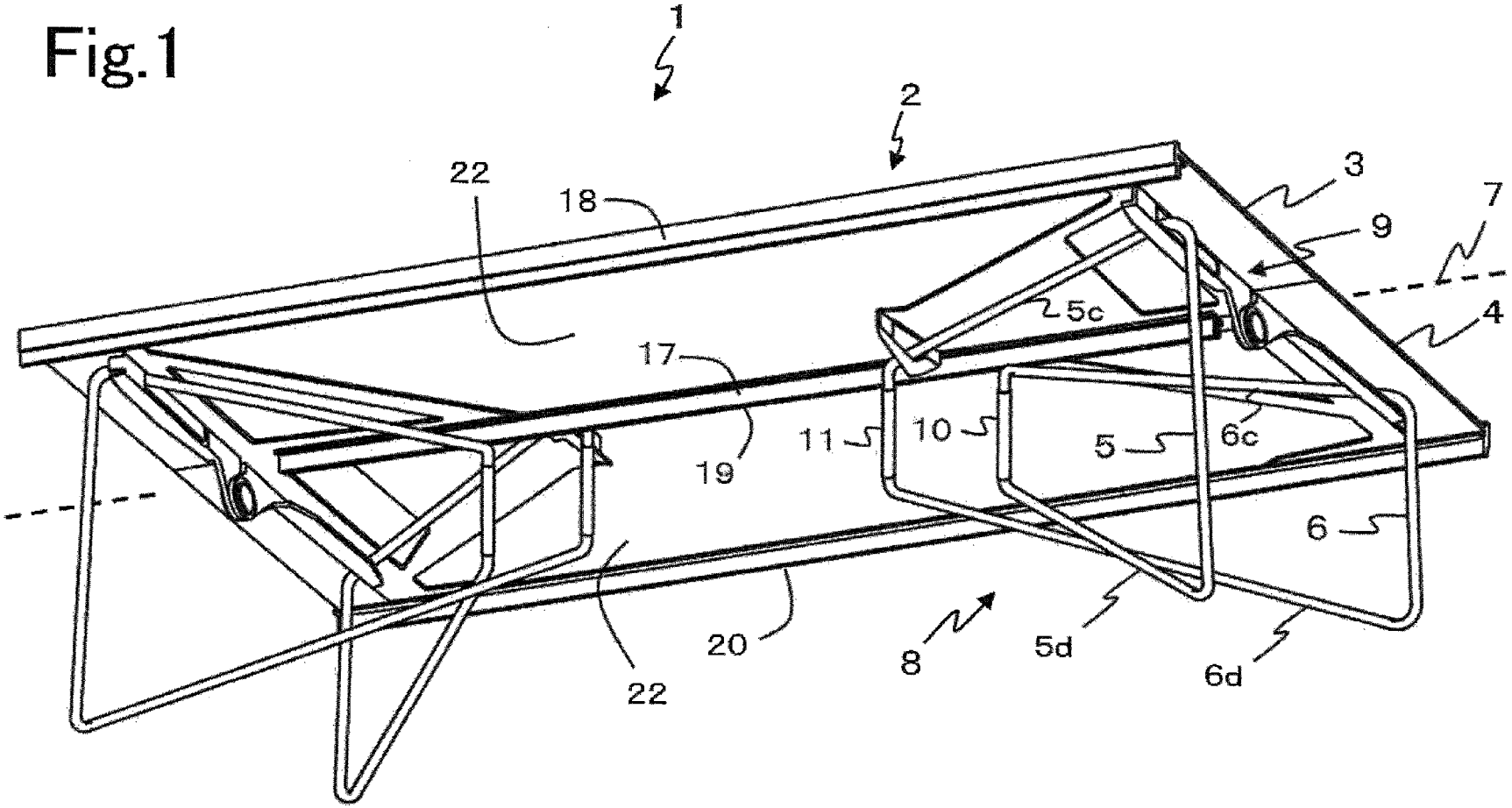
FIG. 1 is a perspective view of a folding table.

As shown in FIG. 1, a folding table 1 includes: two tabletop members 3 and 4 that are connected with each other pivotably with one edges thereof serving as an axis 7 of pivot, and can be folded such that the lower surface sides thereof face each other; and a plurality of leg members 5 and 6 that are disposed on a lower surface of a tabletop 2 formed by unfolding the two tabletop members 3 and 4 right and left, in order to support the tabletop 2. The folding table 1 further includes a separation biasing unit 8 that causes the two leg members 5 and 6, disposed on the lower surface of the tabletop and positioned in opposition across the axis 7 of pivot of the tabletop members 3 and 4, to move away from each other; and a movably coupling unit 9 that couples the leg members 5 and 6 to the tabletop members 3 and 4 in such a manner as to be movable from the one edge side, serving as the axis 7 of pivot, of the tabletop members 3 and 4, to the other edge side thereof. Although the table 1 including four leg members 5 and 6 is exemplary illustrated in FIG. 1, this should not be construed in a limiting sense, and an appropriate number of leg members may be disposed in accordance with the size of the tabletop 2.

As described above, the separation biasing unit 8 biases the two leg members 5 and 6, disposed in opposition across the axis 7 of pivot of the tabletop members 3 and 4, to move away from each other. The movably coupling unit 9 couples the leg members 5 and 6 to the tabletop members 3 and 4 in such a manner as to be movable from the one edge side, serving as the axis 7 of pivot, of the tabletop members 3 and 4, to the other edge side thereof. Thus, when the tabletop members 3 and 4 are pivoted so that the tabletop 2 is unfolded, the two biased leg members 5 and 6 are unfolded right and left on the lower surface of the tabletop 2 with the coupled positions moving as the tabletop members 3 and 4 pivot. As a result, the folding table 1 can be unfolded and set up. When the tabletop 2 is folded by pivoting the tabletop members 3 and 4, the two leg members 5 and 6 are pressed from right and left by the lower surfaces of the two tabletop members 3 and 4 to be folded toward the center against the biasing force. Thus, the two leg members 5 and 6 can be accommodated between the two tabletop members 3 and 4, and thus the folding table 1 can transition to the compact state (FIGS. 5A to 5E).

The shape and the material of the separation biasing unit 8 are not particularly limited, as long as the separation biasing unit 8 has the function of moving the two leg members 5 and 6 away from each other to be unfolded right and left. Thus, for example, the separation biasing unit 8 may have the configuration of coupling the two leg members 5 and 6 with each other through an elastic body, and causing the two leg members to move away from each other by elastic force of the elastic body. Alternatively, parts of two leg members, each formed of an elastic body, may be coupled with each other, and the two leg members may be moved away from each other by elastic force of the elastic bodies, for example. In the latter case, the separation biasing units can be integrally formed with the leg members, whereby the number of parts can be reduced. Thus, a rigid, light weighted, and highly portable folding table can be obtained.

Figure 2A:
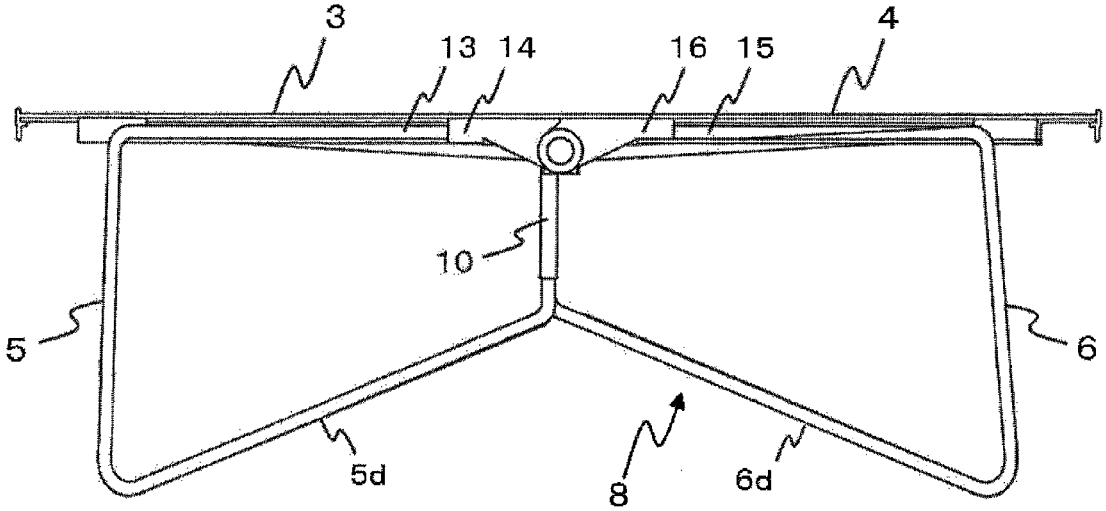
(FIG. 2A is a side view and FIG. 2B is a bottom view)
Figure 2B:
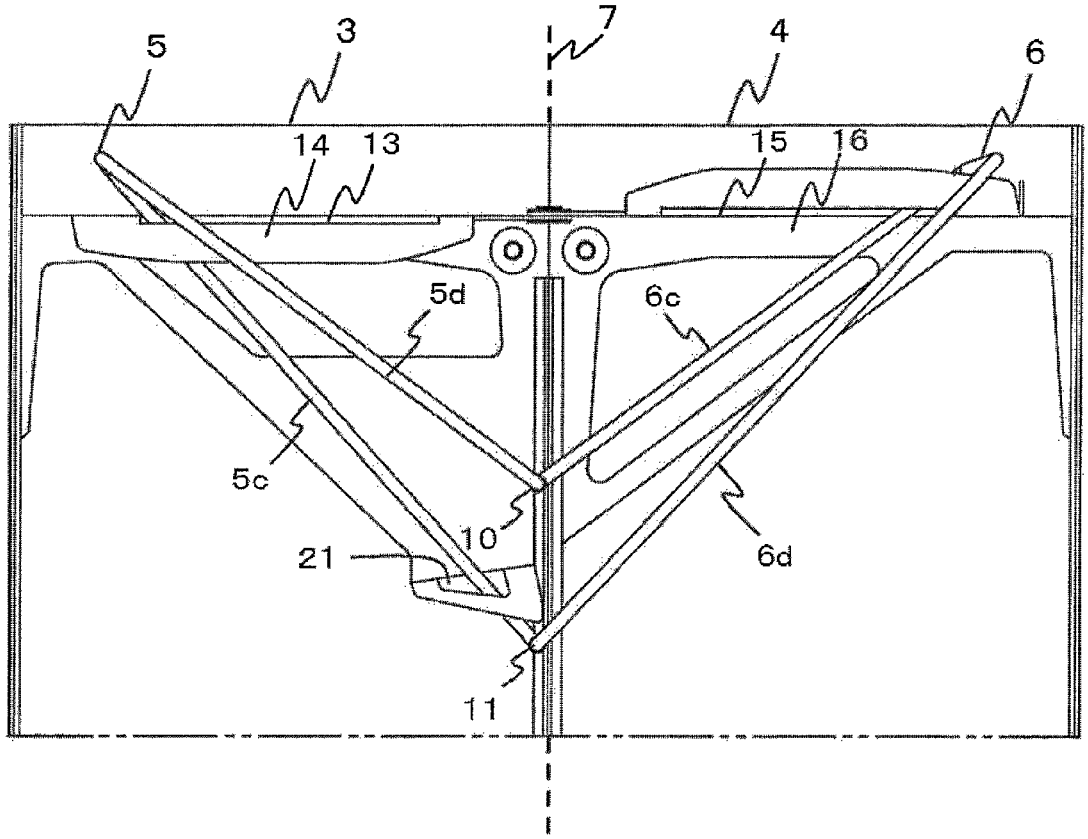
Figure 3A:
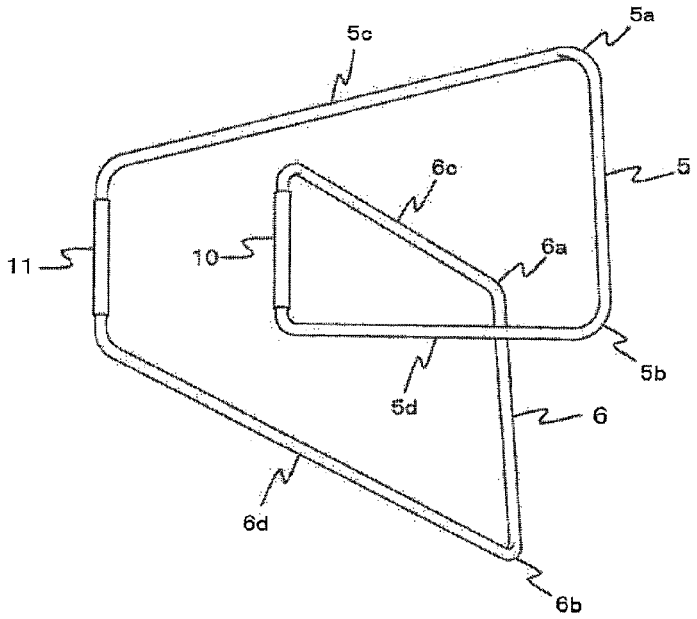
(FIG. 3A shows an assembled state.

As shown in FIG. 3, the separation biasing unit 8 may be formed as follows. Specifically, both ends of rod-shaped elastic bodies (elastic metal rod, for example) forming the two leg members 5 and 6 are bent. A first pivotably coupling portion 10 couples, in a horizontally pivotable manner, a distal end of a lower end extending portion 5*d* extending from a lower end 5*b* of one leg member 5 with a distal end of a upper end extending portion 6*c* extending from an upper end 6*a* of the other leg member 6. A second pivotably coupling portion 11 couples, in a horizontally pivotable manner, a distal end of an upper end extending portion 5*c* extending from an upper end 5*a* of the one leg member 5 with a distal end of a lower end extending portion 6*d* extending from a lower end 6*b* of the other leg member 6. The first pivotably coupling portion 10 and the second pivotably coupling portion 11 may be disposed apart from each other along the axis 7 of pivot of the tabletop members 3 and 4 (FIG. 2).

Figure 3B:
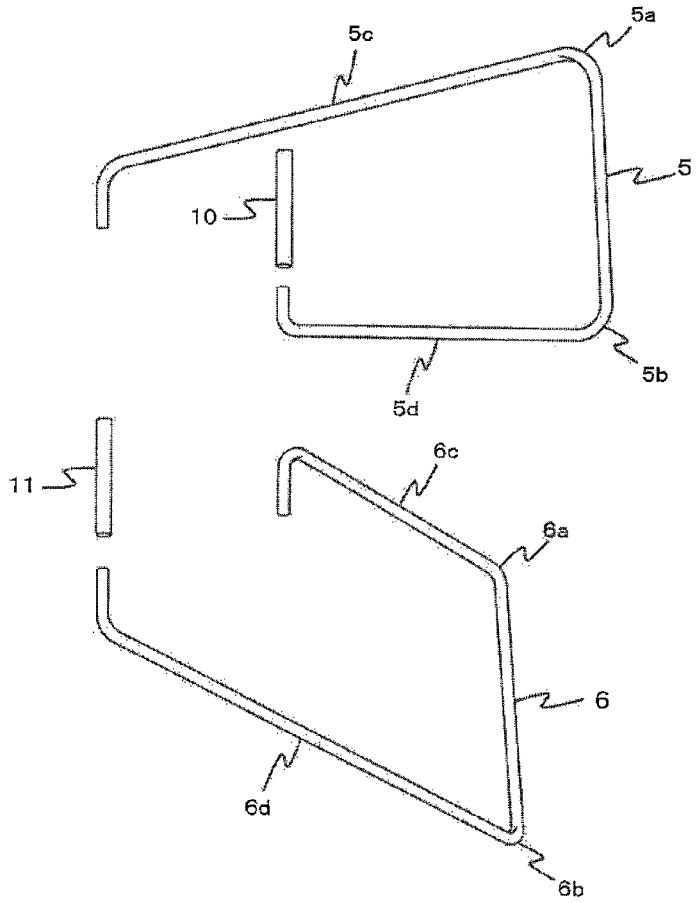
FIG. 3B shows an exploded state)

As shown in FIG. 3B, a tubular pipe may be used as the first pivotably coupling portion 10 and the second pivotably coupling portion 11. The bent distal end of the upper end extending portion 6*c* and the bent distal end of the lower end extending portion 5*d* are respectively inserted into both end openings of the first pivotably coupling portion 10 from upper and lower directions. The bent distal end of the upper end extending portion 5*c* and the bent distal end of the lower end extending portion 6*d* are respectively inserted into both end openings of the second pivotably coupling portion 11 from upper and lower directions. Thus, the upper end extending portion 6*c* and the lower end extending portion 5*d*, as well as the upper end extending portion 5*c* and the lower end extending portion 6*d*, can be coupled with each other in a horizontally pivotable manner.

Figure 4A:
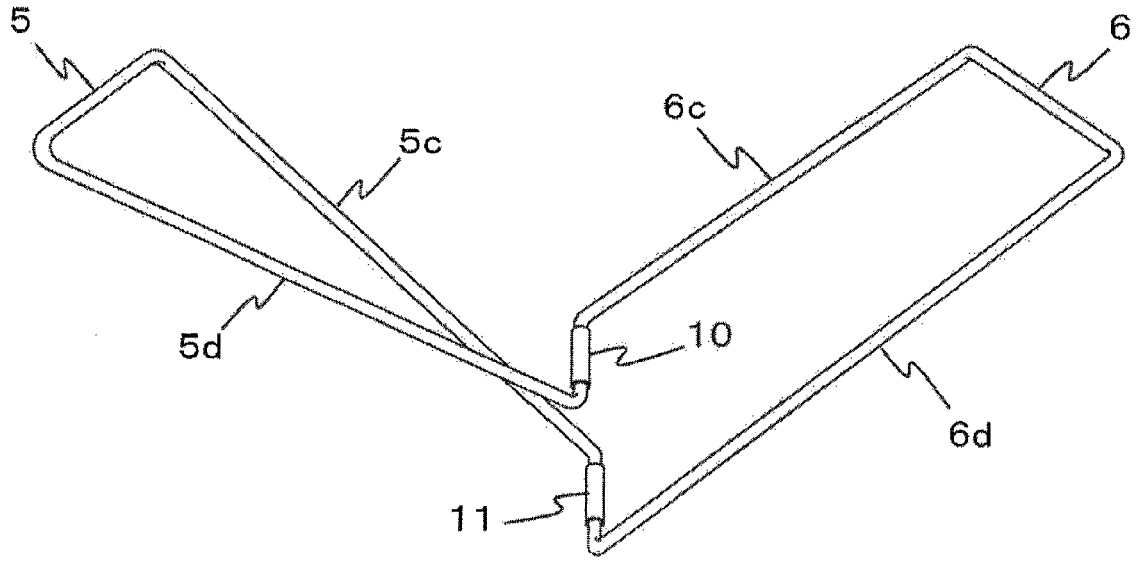
(FIG. 4A is a state where leg members are unfolded.
Figure 4B:
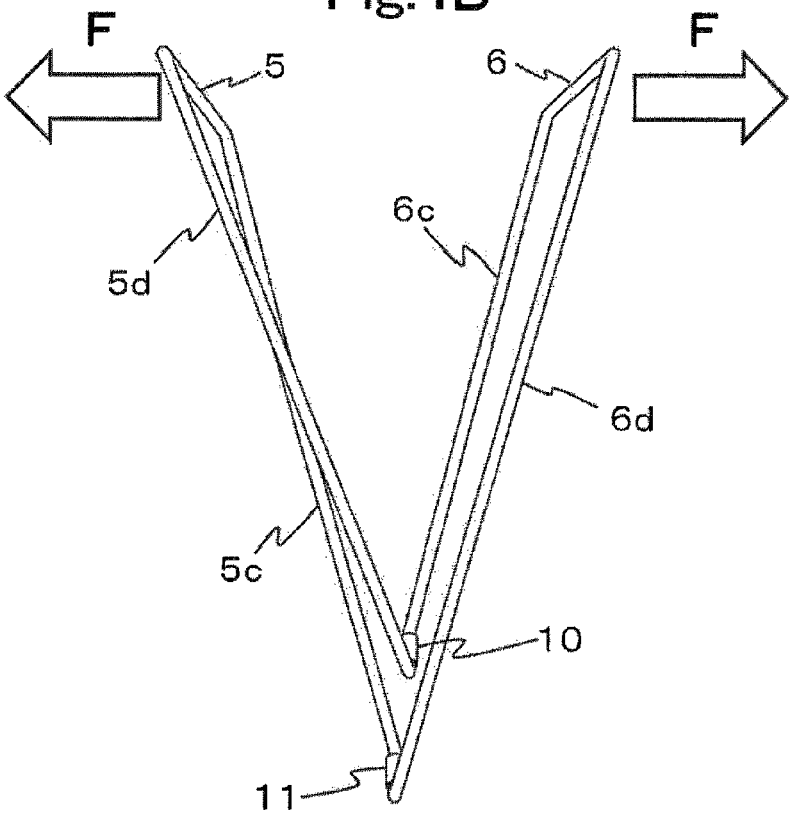
FIG. 4B is a state where the leg members are slightly folded)
Figure 5A:
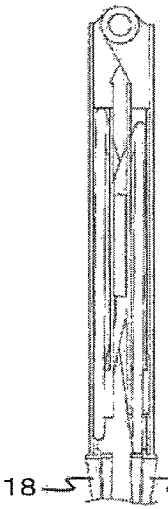
(FIG. 5A is a folded state.
Figure 5B:
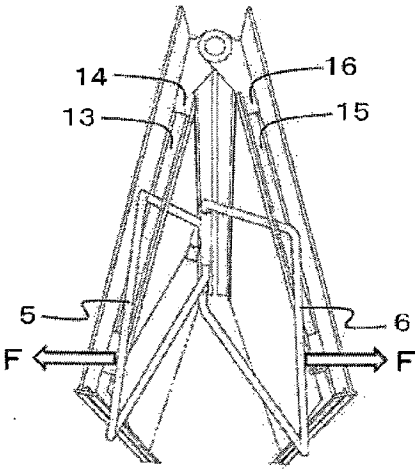
FIGS. 5B to 5D are states in the middle of unfolding (folding)
Figure 5C:
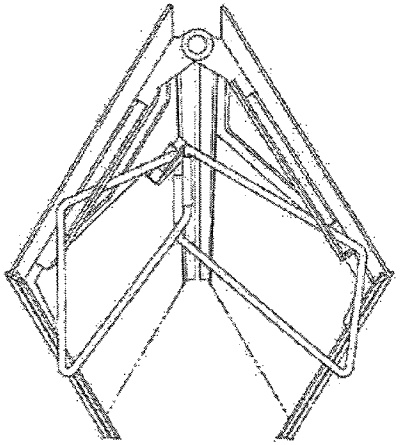
Figure 5D:
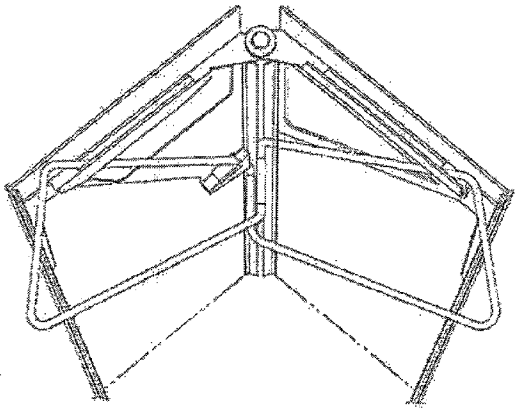
Figure 5E:
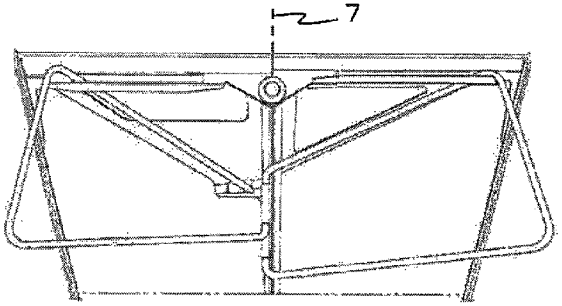
FIG. 5E is a unfolded state).

As shown in FIG. 4, in the separation biasing unit 8, the first pivotably coupling portion 10 and the second pivotably coupling portion 11 move close to each other when the two leg members 5 and 6 move close to each other. When the relative position between the upper end extending portion and the lower end extending portion on both sides of the leg member changes, the elastic force (resilience to return to the original position) is produced in the rod-shaped elastic body (elastic metal rod, for example). Thus, the two leg members 5 and 6 can be moved away from each other by the elastic force. It can be regarded that, in the leg member 5, the elastic force (resilience), produced when the two leg members 5 and 6 move closer to each other, is mainly produced against the torsion force applied to the rod-shaped elastic body, as the upper end extending portion 5*c* and the lower end extending portion 5*d* relatively pivot about the axis of the leg member 5.

The following state is exemplified in FIG. 3. Specifically, the first pivotably coupling portion 10 couples, in a horizontally pivotable manner, the distal end of the lower end extending portion 5*d* extending from the lower end 5*b* of the one leg member 5 with the distal end of the upper end extending portion 6*c* extending from the upper end 6*a* of the other leg member 6. The second pivotably coupling portion 11 couples, in a horizontally pivotable manner, the distal end of the upper end extending portion 5*c* extending from the upper end 5*a* of the one leg member 5 with the distal end of the lower end extending portion 6*d* extending from the lower end 6*b* of the other leg member 6. Alternatively, the first pivotably coupling portion 10 may couple, in a horizontally pivotable manner, the distal ends of the upper end extending portions 5*c* and 6*c* respectively extending from the upper ends 5*a* and 6*a* of the two leg members 5 and 6, and the second pivotably coupling portion 11 may couple, in a horizontally pivotable manner, the distal ends of the lower end extending portions 5*d* and 6*d* respectively extending from the lower ends 5*b* and 6*b* of the two leg members 5 and 6. The first and the second pivotably coupling portions 10 and 11 may be disposed to be separated along the axis 7 of pivot of the tabletop members 3 and 4 (not elaborated in the figures). The elastic force for biasing the leg members 5 and 6 to move away from each other can be obtained also with this configuration.

As shown in FIG. 2, guide members 14 and 16 disposed on the lower surfaces of the tabletop members 3 and 4 and including through holes 13 and 15 having opening plane substantially orthogonal to the lower surface of the tabletop 2 may be disposed as the movably coupling unit 9. The through holes 13 and 15 extend from the one edge side, serving as the axis 7 of pivot, of the tabletop members 3 and 4, to the other edge side thereof. The upper end extending portions 5*c* and 6*c*, respectively extending from the upper ends 5*a* and 6*a* of the two leg members 5 and 6, are inserted into the through holes 13 and 15 of the guide members 14 and 16. Thus, the leg members 5 and 6 can be coupled to the tabletop members 3 and 4 in such a manner as to be movable from the one edge side, serving as the axis 7 of pivot, of the tabletop members 3 and 4, to the other edge side thereof.

The guide members 14 and 16 couple the leg members 5 and 6 to the tabletop members 3 and 4 in such a manner as to be movable along the lower surfaces of the tabletop members 3 and 4, with the upper end extending portions 5*c* and 6*c* of the leg members 5 and 6 inserted to the through holes 13 and 15 formed in the guide members 14 and 16. Thus, at least one through hole needs to be formed in each leg member. Alternatively, different positions of the upper end extending portion of the leg member may be inserted to a plurality of through holes formed in the guide member, whereby the direction, in which the upper end extending portion moves, can be more surely regulated. In the guide member 14 shown in FIG. 2, a through hole 21 is formed in addition to the through hole 13. The upper end extending portion 5*c* of the leg member 5 is inserted to the through holes 13 and 21, whereby the horizontal unfolding can be surely achieved with the upper end extending portion 5*c* moving along the lower surface of the tabletop member 3.

With such a movably coupling unit 9 provided, when the tabletop members 3 and 4 are pivoted so that the tabletop 2 is unfolded, the two leg members 5 and 6 biased by the pivoting of the tabletop members 3 and 4 are unfolded right and left, through the movement of the upper end extending portions 5*c* and 6*c* disposed through the through holes 13 and 15 of the guide members 14 and 16. Thus, the folding table 1 can be set up (FIGS. 5A to E). When the tabletop 2 is folded by pivoting the tabletop members 3 and 4, the two leg members 5 and 6 are pressed from right and left by the lower surfaces of the two tabletop members 3 and 4, to be folded toward the center against the force applied by the separation biasing unit 8, with the upper end extending portions 5*c* and 6*c* moving in the through holes 13 and 15, to be accommodated between the two tabletop members 3 and 4. Thus, the folding table 1 can be folded compactly.

The two table members 3 and 4 may be coupled with each other by attaching a coupling device such as a hinge. Alternatively, the two table members 3 and 4 may be coupled to each other pivotably by disposing a tubular member on side portions of the two tabletop members 3 and 4 to be coupled, and inserting a core member into the tubular member to form a hinge structure, for example. Furthermore, the tabletop 2 may be able to be folded such that the lower surface sides of the two tabletop members 3 and 4 face each other, by pivotably coupling adjacent facing portions of the two guide members 14 and 16 disposed on the two pivotable tabletop members 3 and 4 so as to oppose each other across the axis 7.

By pivotably coupling the two tabletop members 3 and 4 with each other, with the guide members 14 and 16 provided to the tabletop members 3 and 4 as described above, the number of components can be reduced. Thus, a light weighted and thus highly portable rigid folding table can be obtained.

Side walls 17, 18, 19, and 20 are disposed along the one edge serving as the axis 7 and the opposite edges on the lower surfaces of the tabletop members 3 and 4. Thus, shallow recesses 22, surrounded by the side walls 17, 18, 19, and 20 and the guide members 14 and 16, can be formed on the lower surfaces of the tabletop members 3 and 4. The shallow recesses 22 formed on the lower surfaces of the tabletop members 3 and 4 can improve the rigidity of the tabletop members 3 and 4. Thus, the light weighted and highly portable folding table 1 can be obtained with thin tabletop members 3 and 4.

The side walls 18 and 20 are disposed along the edges on the opposite sides to the axis 7 of pivot on the lower surfaces of the tabletop members 3 and 4. Thus, when the two tabletop members 3 and 4 are pivoted to fold the tabletop 2, the leg members 5 and 6, the separation biasing unit 8, and the movably coupling unit 9 can be accommodated within the space surrounded by the two tabletop members 3 and 4 and the side walls 18 and 20. As a result, an even more highly portable folding table 1 can be obtained.

The tabletop members 3 and 4 are preferably formed of a metal material. The tabletop members 3 and 4 made of metal can be made thin, and thus the highly portable folding table 1 with a small thickness in a folded state can be obtained. The tabletop members 3 and 4 and the side walls 17, 18, 19, and 20 can be integrally formed, and thus higher productivity can be further achieved. The tabletop members 3 and 4 made of metal are free of troubles such as deformation due to heat and burning of the tabletop members 3 and 4 when cooking is performed for a long period of time with a cooking burner placed on the upper surface of the tabletop 2. Thus, the user can enjoy recreation comfortably and safely.

What is claimed is:

1. A folding table comprising:

two tabletop members that are pivotally coupled a pivot and are able to be folded such that each of lower surface sides thereof face each other, each of the two tabletop members comprising one edge and other edge, the one edge and the other edge being disposed parallel to an axis of the pivot;

a plurality of leg members that are disposed on a lower surface of a tabletop formed by unfolding the two tabletop members with respect to the axis of the pivot, in order to support the tabletop;

a separation biasing unit that biases two of the plurality of leg members with elastic force and causes the two leg members to move away from each other so that the two leg members are positioned opposite each other with respect to the axis of the pivot; and a movably coupling unit that couples the leg members to the tabletop members in such a manner that each of the two leg members are moveable from a side of the one edge to a side of the other edge, wherein when the tabletop members are unfolded to form the tabletop, the separation biasing unit and the movably coupling unit cause each of the two leg members to be unfolded from the side of the one edge to the side of the other edge along the lower surface of the tabletop, as the tabletop members pivot.

2. The folding table according to claim 1, wherein the separation biasing unit couples the two leg members with each other through an elastic body, and causes the two leg members to move away from each other with elastic force of the elastic body.

3. The folding table according to claim 2, wherein side walls are disposed on the lower surfaces of the tabletop members, along edges on opposite sides to the axis of pivot, such that when the tabletop members pivot and the tabletop is folded, the leg members, the separation biasing unit, and the movably coupling unit are accommodated in a space surrounded by the tabletop members and the side walls.

4. The folding table according to claim 1, wherein the separation biasing unit couples together parts of the two leg members, each made of an elastic body, and causes the two leg members to move away from each other with elastic force of the elastic body.

5. The folding table according to claim 4, wherein side walls are disposed on the lower surfaces of the tabletop members, along edges on opposite sides to the axis of pivot, such that when the tabletop members pivot and the tabletop is folded, the leg members, the separation biasing unit, and the movably coupling unit are accommodated in a space surrounded by the tabletop members and the side walls.

6. The folding table according to claim 4, wherein the separation biasing unit is formed by bending a rod-shaped elastic body forming the two leg members, and disposing a first pivotably coupling portion and a second pivotably coupling portion apart from each other along the axis of pivot of the tabletop members, the first pivotably coupling portion coupling, in a horizontally pivotable manner, a distal end of a lower end extending portion extending from a lower end of one leg member with a distal end of an upper end extending portion or a lower end extending portion extending from an upper end or a lower end of another leg member, the second pivotably coupling portion coupling, in a horizontally pivotable manner, a distal end of an upper end extending portion extending from an upper end of the one leg member with a distal end of the upper end extending portion or the lower end extending portion extending from the upper end or the lower end of the other leg member, to produce the elastic force in the rod-shaped elastic body when the two leg members move closer to each other such that the two leg members move away from each other by the elastic force.

7. The folding table according to claim 6, wherein side walls are disposed on the lower surfaces of the tabletop members, along edges on opposite sides to the axis of pivot, such that when the tabletop members pivot and the tabletop is folded, the leg members, the separation biasing unit, and the movably coupling unit are accommodated in a space surrounded by the tabletop members and the side walls.

8. The folding table according to claim 6, wherein the movably coupling unit movably couples the leg members to the tabletop members by providing a guide member that is disposed on the lower surface of each of the tabletop members and includes a through hole extending from the side of the one edge, serving as the axis of pivot, of the table top members, to the side of the other edge thereof, and by inserting the upper end extending portion extending from the upper end of the leg member into the through hole.

9. The folding table according to claim 8, wherein side walls are disposed on the lower surfaces of the tabletop members, along edges on opposite sides to the axis of pivot, such that when the tabletop members pivot and the tabletop is folded, the leg members, the separation biasing unit, and the movably coupling unit are accommodated in a space surrounded by the tabletop members and the side walls.

10. The folding table according to claim 8, wherein two guide members are respectively disposed on the two pivotable tabletop members so as to oppose each other across the axis, and the tabletop is able to be folded such that the lower surface sides of the two tabletop members face each other by pivotably coupling adjacent facing portions of the two guide members with each other.

11. The folding table according to claim 10, wherein side walls are disposed on the lower surfaces of the tabletop members, along edges on opposite sides to the axis of pivot, such that when the tabletop members pivot and the tabletop is folded, the leg members, the separation biasing unit, and the movably coupling unit are accommodated in a space surrounded by the tabletop members and the side walls.

12. The folding table according to claim 1, wherein side walls are disposed on the lower surfaces of the tabletop members, along edges on opposite sides to the axis of pivot, such that when the tabletop members pivot and the tabletop is folded, the leg members, the separation biasing unit, and the movably coupling unit are accommodated in a space surrounded by the tabletop members and the side walls.

* * * * *